United States Patent [19]

Leland

[11] Patent Number: 5,005,639

[45] Date of Patent: Apr. 9, 1991

[54] FERROFLUID PISTON PUMP FOR USE WITH HEAT PIPES OR THE LIKE

[75] Inventor: John E. Leland, Loudonville, Ohio

[73] Assignee: The United States of America as represented by the Secretary of the Air Force, Washington, D.C.

[21] Appl. No.: 502,966

[22] Filed: Apr. 2, 1990

Related U.S. Application Data

[62] Division of Ser. No. 172,676, Mar. 24, 1988, Pat. No. 4,967,831.

[51] Int. Cl.[5] ..... F28D 15/02

[52] U.S. Cl. ..... 165/104.25; 165/104.23; 417/418; 417/417; 384/12; 384/42; 384/133

[58] Field of Search ..... 417/417, 418, 416; 384/133, 12, 42; 165/104.25, 104.23, 104.31

[56] References Cited

U.S. PATENT DOCUMENTS

| | | | |
|---|---|---|---|
| 4,531,846 | 7/1985 | Raj | 384/133 |
| 4,572,285 | 2/1986 | Botts et al. . | |
| 4,628,384 | 12/1986 | Raj et al. | 384/478 |
| 4,630,943 | 12/1986 | Stahl et al. | 384/133 |
| 4,645,960 | 2/1987 | Hoffman | 310/90.5 |
| 4,717,266 | 1/1988 | Hart, Jr. et al. | 384/133 |

FOREIGN PATENT DOCUMENTS

| | | | |
|---|---|---|---|
| 233378 | 11/1985 | Japan | 417/417 |

OTHER PUBLICATIONS

What are Ferrofluids?, pamphlet copyrighted in 1986, by Ferrofluids Corporation.

*Primary Examiner*—Albert W. Davis, Jr.
*Attorney, Agent, or Firm*—Fred L. Sinder; Donald J. Singer

[57] ABSTRACT

A long life, very low friction pump for use in a heat pipe pump or the like is disclosed. A first pump uses magnetically confined ferrofluid rings as both sealer and lubricant for a sliding pump piston in a two sided piston pump that minimizes the seal pressures on both sides of the ferrofluid seals. A second pump uses a magnetically confined ferrofluid slug as a self-sealing and self-repairing pump piston.

11 Claims, 3 Drawing Sheets

FERROFLUID PISTON PUMP FOR USE WITH HEAT PIPES OR THE LIKE

RIGHTS OF THE GOVERNMENT

The invention described herein may be manufactured and used by or for the Government of the United States for all governmental purposes without the payment of any royalty.

This is a division of application Ser. No. 07/172,676, filed Mar. 24, 1988, now U.S. Pat. No. 4,967,831, granted Nov. 6, 1990.

BACKGROUND OF THE INVENTION

The invention relates generally to pumps, and more specifically to a very long life ferrofluid sealed and lubricated piston pump for use with heat pipes.

Heat pipes are used to transport large amounts of heat, or thermal energy, over short distances. Among other uses, they provide a generally reasonably-sized means for transferring waste heat from thermodynamic processes to heat sinks that, for a variety of reasons, cannot be placed nearer to the site of the thermodynamic activity. Their use is particularly applicable to spacecraft.

Heat pipes use successive evaporation and condensation of a working fluid to take advantage of the high heat of vaporization of most fluids in order to absorb large amounts of heat for transporting. Heat pipes typically use capillary forces, through a wick, to return condensed working fluid, or condensate, from a heat pipe condenser section, where transported thermal energy is given up at a heat sink, to an evaporator section, where the thermal energy to be transported is absorbed.

Unfortunately, heat pipe capillary wicks develop pumping pressures sufficient to transport heat only over limited distances. Future space missions will require transport distances beyond the limits of capillary pumping. A pump augmented capillary or a purely pump driven system are seen as viable solutions to this problem. At present, however, the life times of most mechanical pumps are limited by frictional wear of their moving parts. Life times of between 7 and 10 years will be required for most future space platform applications, a life time not possible with present pumps.

It is seen, therefore, that there is a need for a pump, suitable for use with space based heat pipes, that has a very long life.

It is, therefore, a principal object of the present invention to provide a pump, suitable for use with space based heat pipes, that has a very long life.

It is another object of the present invention to provide a pump that has a minimum of moving parts.

It is yet another object of the present invention to provide a pump that achieves its long life in part by minimizing friction between moving pump parts.

It is a feature of the present invention that it is also suitable for use in terrestrial heat pipe applications where long transport distances are required at relatively inaccessible locations.

It is an advantage of the present invention that its piston seals are generally self-repairing.

SUMMARY OF THE INVENTION

The invention provides a very low friction, long life pump that is particularly suitable for use with space based heat pipes. The unique discovery of the present invention is that the problem of frictional wear of typical mechanical pumps is solved by a pump piston having permanent magnet sections, and their accompanying magnetic fields, which hold in place ferrofluid rings surrounding the pistons. The ferrofluid rings suspend the piston inside a conduit and provide both lubrication and sealing. A slug of ferrofluid material may also serve as a piston.

Accordingly, the invention is directed to a pump comprising a conduit, a piston inside the conduit, wherein the piston includes at least one permanent magnet section, and ferrofluid rings next to the permanent magnet sections held in place by the magnetic fields of the permanent magnets.

The invention may also include means for creating an oscillating magnetic field for moving the piston. The oscillating magnetic field may be created by use of a permanent ring magnet surrounding one end of the conduit and an electromagnet surrounding the conduit at a different position from the permanent magnet.

The ferrofluid rings may be partially enclosed within annular grooves in nonmagnetic sections next to the magnetic sections.

The invention is further directed to a pump for pumping fluid from a first position to a second position, comprising a first conduit connecting the first position to the second position, the first conduit having, in order, first, second and third openings along its length; a second conduit connecting the first and third openings, the second conduit having a fourth opening along its length; a third conduit connecting the second opening to the fourth opening; at least four one-way valves positioned inside the first and second conduits, wherein at least one one-way valve is positioned on each side of the second and fourth openings, whereby the one-way valves permit the fluid to flow inside the first and second conduits only in the direction from the first position to the second position; a piston inside the third conduit, wherein the piston includes a permanent magnet section; and, next to the permanent magnet section, a ring of ferrofluid surrounding the piston and held in place by the magnetic field of the permanent magnet, whereby the ferrofluid ring suspends the piston inside the third conduit.

The pump may also be configured as a first conduit connecting the first position to the second position, the first conduit having an opening along its length; a second conduit connected at one end to the opening along the length of the first conduit; at least two one-way valves positioned inside the first conduit, wherein at least one one-way valve is positioned on each side of the opening along the length of the first conduit, whereby the one-way valves permit the fluid to flow inside the first conduit means only in the direction from the first position to the second position; a piston inside the second conduit, wherein the piston includes a permanent magnet section; and, next to the permanent magnet section, a ring of ferrofluid surrounding the piston and held in place by the magnetic field of the permanent magnet, whereby the ferrofluid ring suspends the piston inside the second conduit.

The invention also includes the piston separate from the pump.

The invention further includes the use of a ferrofluid slug as a piston.

DESCRIPTION OF THE DRAWINGS

The invention will be more clearly understood from a reading of the following detailed description in conjunction with the accompanying drawings wherein.

DETAILED DESCRIPTION

Figure 1:
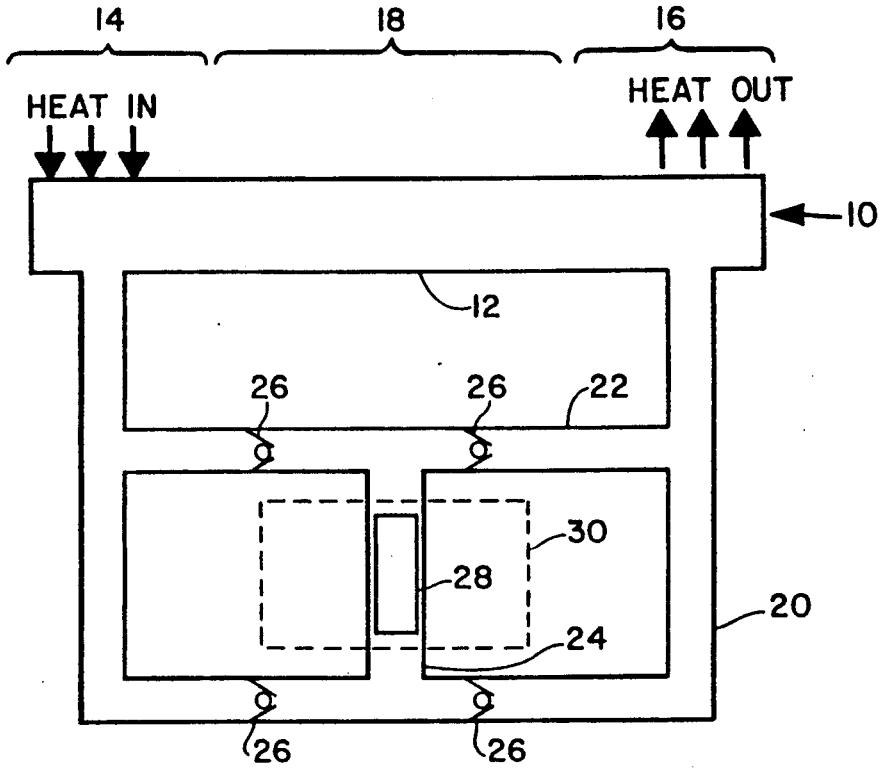
FIG. 1 shows a simplified cross-sectional view of a pump according to the teachings of the present invention used as part of a pumped heat pipe.

Referring now to FIG. 1 of the drawings, there is shown a simplified cross-sectional view of a pump according to the teachings of the present invention used as part of a pumped heat pipe 10. The prior art components of heat pipe 10 include a sealed container 12, which includes an evaporator section 14, where heat is absorbed, and a condenser section 16, where the absorbed heat is given up to a heat sink (not shown). A transport section 18, generally adiabatic, separates evaporator section 14 from condenser section 16 and provides a path for evaporated working fluid to flow to condenser section 16. A typical capillary pumped heat pipe would also include a continuous capillary wick covering the inside of container 12 at and between evaporator section 14 and condenser section 16 for condensed working fluid to return to evaporator section 14. The heat pipe used with the present invention may or may not include a wick, depending upon whether an augmented capillary or a purely mechanically pumped heat pipe is desired.

The present invention adds a separate conduit 20 connecting evaporator section 14 to condenser section 16 for return of liquid condensate to evaporator section 14. A second conduit 22 connects across conduit 20 to provide an alternate path for the return of liquid condensate. A third conduit 24 connects conduits 20 and 22. Conduits 20, 22 and 24 are shown enlarged in relation to container 12 for clarity.

One-way, or check, valves 26 are positioned inside conduits 20 and 22 on both sides of their connections to conduit 24 so that the liquid condensate can flow only in the direction from condenser section 16 to evaporator section 14. A movable piston 28 is enclosed inside conduit 24. Piston 28 comprises in part, as is more fully described below, a highly magnetically susceptible material so that it will be moved by a changing magnetic field 30. By making magnetic field 30 oscillate to move piston 28 back and forth inside conduit 24, the piston 28 movement, combined with the action of one-way valves 26, will pump liquid condensate from condenser section 16 to evaporator section 14.

Figure 2:
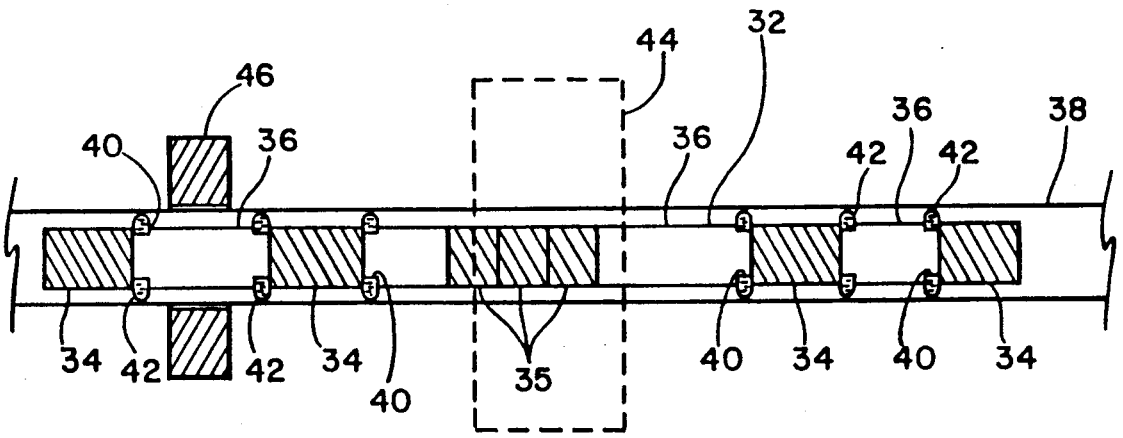
FIG. 2 shows a cross-sectional view of a ferrofluid sealed and lubricated piston according to the teachings of the present invention.

FIG. 2 shows an embodiment of a piston 32 comprising cylindrical permanent magnets 34 cemented between lengths of cylindrical plastic, or other nonmagnetic material, rods 36. Additional permanent magnets 35 form the center portion of piston 32 and provide additional magnetically susceptible material for acting upon by an oscillating magnetic field. Piston 32 rides inside conduit 38. Annular grooves 40 are located next to permanent magnets 34. Toroidally shaped rings 42 of liquid ferrofluid fill grooves 40 and extend outside the outer diameter of rods 36 to provide a combination bearing and seal with conduit 38.

Ferrofluids are stable colloidal suspensions of magnetic particles in a carrier liquid. The particles, which have an average size of about 100 Å, are coated with a surfactant to prevent particles from sticking together so that simple Brownian motion is sufficient to keep them apart. In the absence of an external magnetic field, the magnetic moments of individual particles are randomly distributed and the fluid has no net magnetization. In the presence of an external magnetic field, the magnetic moments of individual particles align with the field lines of the applied field almost instantly, reshaping the carrier liquid along the field lines as the particles attempt to move along the field gradient to areas of higher field strength. Carrier liquids are chosen for their chemical, mechanical or other physical properties. Lubricants are generally chosen for use in ferrofluid seals. Ferrofluids are available from Ferrofluidics Corporation, Nashua, N.H.

Ferrofluid rings 42 assume their toroidal shape under the influence of the magnetic fields of permanent magnets 34 to fill the spaces between annular grooves 40 and the inside wall of conduit 38.

Figure 3:
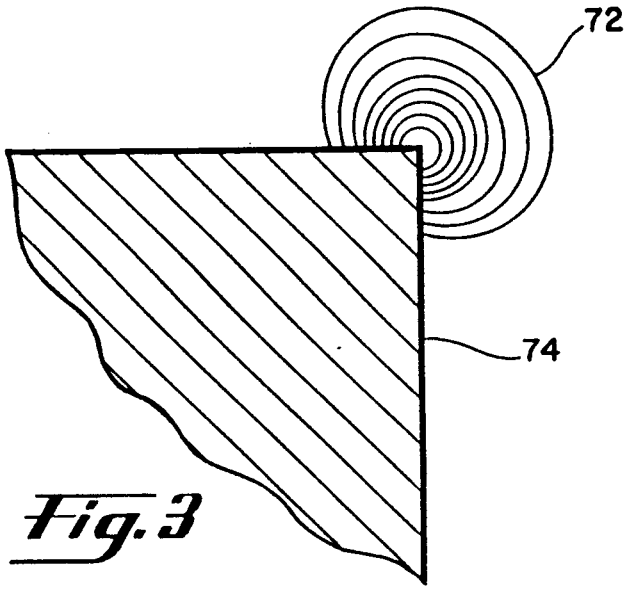
FIG. 3 shows a partial cross-sectional view of magnetic field lines surrounding a corner edge of a permanent magnet.

FIG. 3 shows a partial cross-sectional view of magnetic field lines 72 surrounding a corner edge of a permanent magnet 74. This edge effect makes possible creating a toroidally shaped seal at the end of a single magnet section without requiring a pair of magnets to create a particularly shaped field between them.

The strength of the magnetic field gradient, and the resulting forces maintaining the shape of rings 42, is generally strong enough to suspend, or float, piston 32 away from contacting the inside walls of conduit 38 so that piston 32, aided by the lubricating properties of the ferrofluid carrier liquid, will move freely inside conduit 38. If, for any reason, the integrity of the ferrofluid seal is broken, the magnetic field will automatically pull the ferrofluid back into the desired shape and repair the seal. The strength of the field gradient is also typically sufficiently strong so that an oscillating magnetic field 30, as described in reference to FIG. 1, will not be strong enough to overcome its holding ferrofluid rings 42 in place.

FIG. 2 also shows an embodiment of a means for creating a changing magnetic field to move piston 32. An electromagnet 44 and a permanent ring magnet 46 are positioned as shown at different axial positions along the length of piston 32. When electromagnet 44 is off, the interaction of the magnetic fields of the closest permanent magnets 34 and permanent ring magnet 46 holds piston 32 at rest in place. When electromagnet 44 is turned on, its interaction with the magnetic fields of permanent magnets 34 pulls piston 32 away from permanent ring magnet 46. By oscillating the current to electromagnet 44 to create an oscillating magnetic field, piston 32 will move back and forth to perform its pumping function.

An experimental example of the invention, similar to the FIG. 2 embodiment, has successfully demonstrated the sealing and pumping ability of the invention as part of a heat pipe for use in a spacecraft. The experimental piston was made of 0.125 inch diameter PVC plastic rods, selected for their light weight, cemented between rare earth samarium cobalt permanent magnets, selected for their very strong magnetic fields. An epoxy cement was used. The overall light weight of the piston reduced the magnetic force required to suspend the piston between the conduit walls.

The experimental example included the annular grooves of the FIG. 2 embodiment, primarily to provide space so that excess cement from attaching the permanent magnets to the plastic rods would not extend beyond the piston outer diameter. It will be seen by those with skill in the art that the magnetic fields are primarily what hold the ring bearings in place.

The piston successfully sealed against pressures of over 6 psi. Improved ferrofluids, particularly newly available ferrofluids having higher maximum magnetic susceptibility, are expected to increase this value in the future. A unique feature of this embodiment is that its ferrofluid seals are, instead of the more well known in the art rotary seals, primarily sliding seals. The shearing loads imposed by this requirement compromise their ability to seal against very high pressures. Preliminary calculations for pumps to be used in spacecraft heat pipes show, however, that, after allowing for all system losses, the pumps will be able to successfully pump at 3 psi, far surpassing any existing capillary mechanisms and more than sufficient to satisfy the expected pumping requirement of a spacecraft heat pipe. The FIG. 2 invention embodiment achieves this by using a free floating piston that pumps in both directions as shown. Piston 28 only has to pump against the internal pressure drops of the pump mechanism plus the small pressure drop from the evaporator section to the condenser section. Other pump configurations, such as is shown in the FIG. 5 embodiment described below, require the piston to pump against the substantial positive pressure that develops in the heat pipe as the system heats up during operation, unduly restricting the maximum possible pumping pressure.

Figure 4:
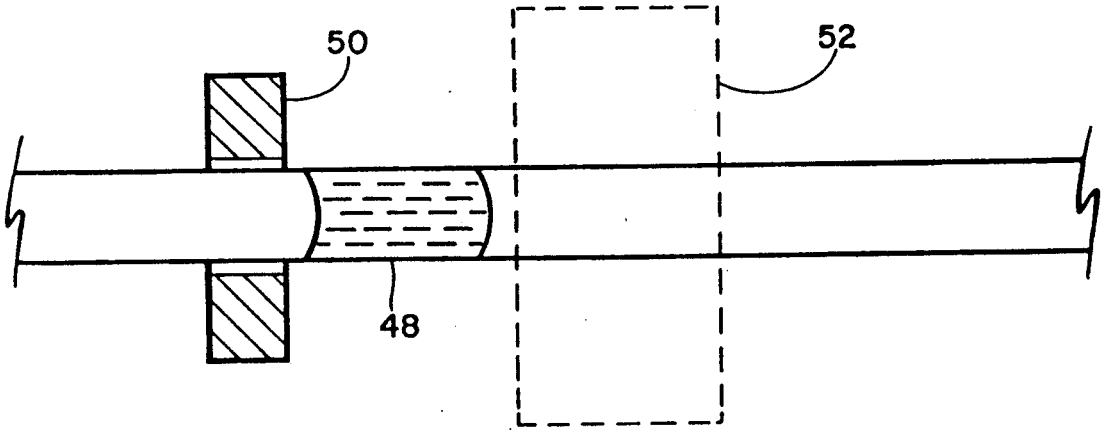
FIG. 4 shows a cross-sectional view of a ferrofluid slug piston according to the teachings of the present invention; and, FIG. 5 shows a simplified cross-sectional view of another embodiment of a pump according to the teachings of the present invention used as part of a pumped heat pipe.

FIG. 4 shows a partial view of another embodiment of the invention which uses a ferrofluid slug 48 as the piston. Ferrofluid slug 48 is restrained by a permanent ring magnet 50 and moved, similarly to solid piston 32 in the FIG. 2 embodiment, by a changing magnetic field created by electromagnet 52. In this embodiment, the entire piston comprises a magnetically susceptible material.

The ferrofluid carrier liquid chosen for either the FIG. 2 or FIG. 4 embodiment must be immiscible with the heat pipe working fluid, particularly in the FIG. 4 embodiment. Preliminary tests performed with a kerosene-based ferrofluid and water interface indicate that sufficient immiscibility is retained for several months at room temperature. Stability at the higher temperatures (300°-350° K.) at which a space based heat pipe pump is likely to operate has not yet been explored. Breakdown of the ferrofluid, if it occurs, is expected to most likely to occur from degradation of the surfactant in the presence of water. A small slug of a gas might be used to separate the water from the ferrofluid slug.

Long life check valves are readily available and are expected to operate flawlessly over the required life of a space based heat pipe pump.

Figure 5:
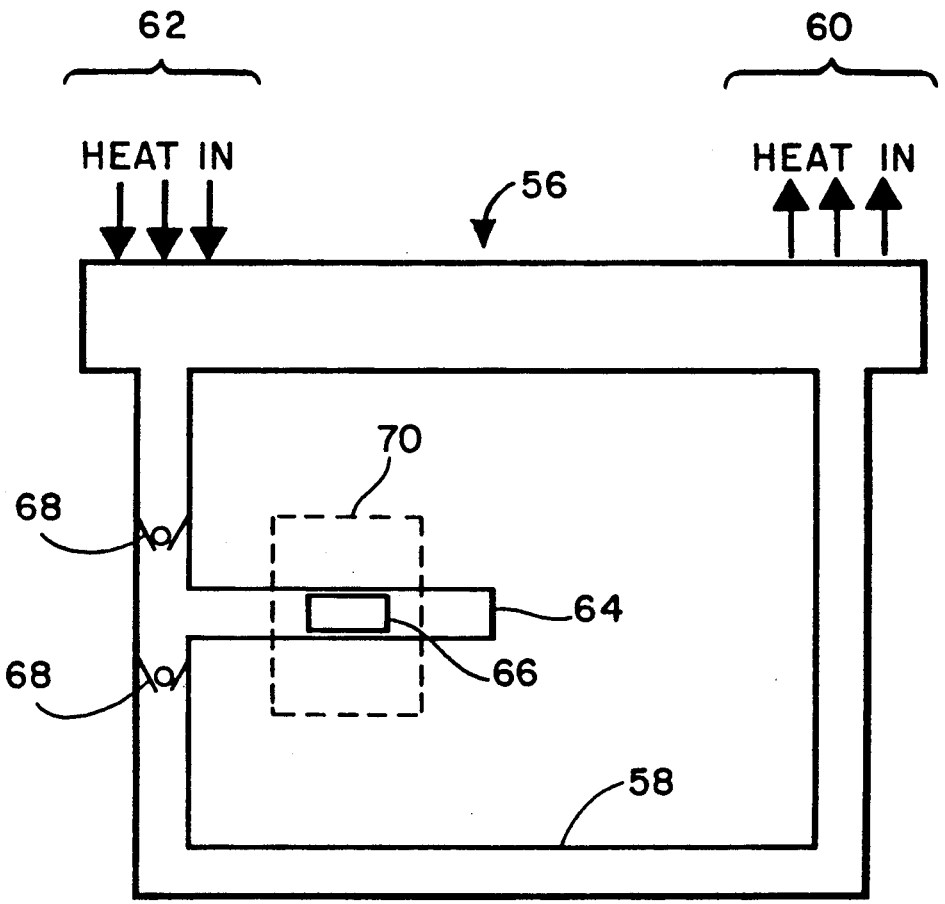

FIG. 5 shows a simplified cross-sectional view of another embodiment of a pump using a ferrofluid sealed or a ferrofluid slug piston and suitable for use with a heat pipe. In this embodiment, the heat pipe pump for a heat pipe 56 comprises a first conduit 58 for transporting liquid condensate from a condenser section 60 to an evaporator section 62 and a second conduit 64 for holding a, at least in part, magnetically susceptible movable piston 66. A pair of one-way valves 68 and an oscillating magnetic field 70 complete the pump. Those with skill in the art will see that back and forth movement of piston 66 inside conduit 64, combined with the action of one-way valves 68, will pump liquid condensate from condenser section 60 to evaporator section 62. As described above, those with skill in the art will see that this embodiment creates greater sealing requirements between the inside wall of conduit 64 and piston 66 than are created in the FIG. 1 embodiment.

The disclosed pump successfully demonstrates the use, as part of a heat pipe pump, of ferrofluid for lubrication and sealing of a magnetically susceptible piston, or of a ferrofluid slug as the piston itself. Additionally, it demonstrates the use of a two sided piston pump to minimize the pressure loading on the piston seals. Although the disclosed use is specialized, it will find application in other areas of piston pumping and applications requiring a sliding seal.

Those with skill in the art will see that permanent magnets 34 of piston 32 of the FIG. 2 embodiment need not be entire cross-sections of piston 32, but may also comprise ring sections, partial ring sections or any of a large variety of functionally equivalent piston ring structures that create a magnetic field for holding a ferrofluid ring. Similarly, the present invention as claimed is intended to include arranging pairs of permanent magnets so that opposite poles may create specially shaped fields for particular applications. It is understood that other modifications to the invention as described may be made, as might occur to one with skill in the field of the invention. Therefore, all embodiments contemplated have not been shown in complete detail. Other embodiments may be developed without departing from the spirit of the invention or from the scope of the claims.

I claim:

1. A pump, comprising:
(a) a conduit;
(b) a piston inside the conduit, wherein the piston includes a permanent magnet section; and,
(c) next to the permanent magnet section, a ring of ferrofluid surrounding the piston and held in place by the magnetic field of the permanent magnet, whereby the ferrofluid ring suspends the piston inside the conduit.

2. The pump according to claim 1, further comprising means for creating an oscillating magnetic field for moving the piston inside the conduit.

3. The pump according to claim 2, wherein the means for creating an oscillating magnetic field includes:
(a) a permanent ring magnet surrounding generally one end of the conduit; and,
(b) an electromagnet surrounding the conduit at a different position from the permanent ring magnet.

4. The pump according to claim 1, further comprising a nonmagnetic section adjacent to the permanent magnet section, wherein the ferrofluid ring is partially enclosed within an annular groove in the adjacent nonmagnetic section.

5. A pump for pumping fluid from a first position to a second position, comprising:

(a) a first conduit connecting the first position to the second position, the first conduit having an opening along its length;

(b) a second conduit connected at one end to the opening along the length of the first conduit;

(c) at least two one-way valves positioned inside the first conduit, wherein at least one one-way valve is positioned on each side of the opening along the length of the first conduit, whereby the one-way valves permit the fluid to flow inside the first conduit means only in the direction from the first position to the second position;

(d) a piston inside the second conduit, wherein the piston includes a permanent magnet section; and, (e) next to the permanent magnet section, a ring of ferrofluid surrounding the piston and held in place by the magnetic field of the permanent magnet, whereby the ferrofluid ring suspends the piston inside the second conduit.

6. The pump according to claim 5, further comprising means for creating an oscillating magnetic field for moving the piston.

7. The pump according to claim 6, wherein the means for creating an oscillating magnetic field includes:

(a) a permanent ring magnet surrounding generally one end of the second conduit; and, (b) an electromagnet surrounding the second conduit at a different position from the permanent ring magnet.

8. The pump according to claim 5, further comprising a nonmagnetic section adjacent to the magnetic section, wherein the ferrofluid ring is partially enclosed within an annular groove in the adjacent nonmagnetic section.

9. A pump piston for pumping fluid through a conduit, comprising:

(a) at least one permanent magnet section; and, (b) next to the permanent magnet section, a ring of ferrofluid surrounding the piston and held in place by the magnetic field of the permanent magnet.

10. The pump piston according to claim 9, further comprising a nonmagnetic section adjacent to the permanent magnet section, wherein the ferrofluid ring is partially enclosed within an annular groove in the adjacent nonmagnetic section.

11. A heat pipe pump for pumping liquid condensate from a condenser section of a heat pipe to an evaporator section, the heat pipe having a transport section for flow of gaseous working fluid, comprising:

(a) a conduit, separate from the transport section, from the condenser section to the evaporator section for transporting liquid condensate;

(b) a piston pump, including a piston, operatively interconnected with the conduit to pump the liquid condensate through the conduit, wherein the piston includes permanent magnet sections;

(c) next to each permanent magnet section, a ring of ferrofluid surrounding the piston and held in place by the magnetic field of the permanent magnet, and;

(d) means for creating an oscillating magnetic field for moving the piston.

* * * * *